US009146572B2

(12) United States Patent
Jackum et al.

(10) Patent No.: US 9,146,572 B2
(45) Date of Patent: Sep. 29, 2015

(54) APPARATUS PROVIDING AN OUTPUT VOLTAGE

(71) Applicant: Infineon Technologies AG, Neubiberg (DE)

(72) Inventors: Thomas Jackum, Gleisdorf (AT); Nicola Da Dalt, Sattendorf (AT); Andrea Cristofoli, Spilimbergo (IT)

(73) Assignee: Infineon Technologies AG, Neubiberg (DE)

( * ) Notice: Subject to any disclaimer, the term of this patent is extended or adjusted under 35 U.S.C. 154(b) by 185 days.

(21) Appl. No.: 13/906,150

(22) Filed: May 30, 2013

(65) Prior Publication Data

US 2014/0354252 A1 Dec. 4, 2014

(51) Int. Cl.
*G05F 1/575* (2006.01)
*G05F 1/625* (2006.01)

(52) U.S. Cl.
CPC ..... *G05F 1/625* (2013.01)

(58) Field of Classification Search
CPC ..... G05F 3/24; G05F 1/56; G05F 1/575; G05F 3/156; G05F 3/1588
USPC ..... 323/265, 273, 281–283, 351
See application file for complete search history.

(56) References Cited

U.S. PATENT DOCUMENTS

| | | | | |
|---|---|---|---|---|
| 6,201,375 | B1 * | 3/2001 | Larson et al. | 323/277 |
| 6,340,918 | B2 * | 1/2002 | Taylor | 330/292 |
| 6,424,121 | B1 * | 7/2002 | Khouri et al. | 320/128 |
| RE38,940 | E * | 1/2006 | Isham et al. | 323/224 |
| 2003/0085693 | A1 * | 5/2003 | Marty | 323/280 |
| 2003/0111986 | A1 * | 6/2003 | Xi | 323/280 |
| 2005/0189934 | A1 * | 9/2005 | Poss | 323/316 |
| 2006/0119335 | A1 * | 6/2006 | Eberlein | 323/282 |
| 2007/0007934 | A1 * | 1/2007 | Imtiaz | 323/274 |
| 2007/0114951 | A1 * | 5/2007 | Tsen et al. | 315/291 |
| 2007/0152644 | A1 * | 7/2007 | Vinn | 323/266 |
| 2007/0216383 | A1 * | 9/2007 | Al-Shyoukh et al. | 323/280 |
| 2008/0007234 | A1 | 1/2008 | Agari | |
| 2008/0191671 | A1 | 8/2008 | Shikata | |
| 2009/0079406 | A1 * | 3/2009 | Deng et al. | 323/280 |
| 2009/0212753 | A1 * | 8/2009 | Lou | 323/277 |
| 2010/0283442 | A1 * | 11/2010 | Nakashima | 323/283 |
| 2011/0181259 | A1 * | 7/2011 | Shen | 323/282 |
| 2013/0027011 | A1 * | 1/2013 | Shih et al. | 323/282 |
| 2013/0076252 | A1 * | 3/2013 | Shao et al. | 315/186 |
| 2013/0154592 | A1 * | 6/2013 | Teh | 323/273 |

FOREIGN PATENT DOCUMENTS

| | | | |
|---|---|---|---|
| CN | 101082823 | A | 12/2007 |
| CN | 101097456 | A | 1/2008 |

* cited by examiner

*Primary Examiner* — Adolf Berhane
(74) *Attorney, Agent, or Firm* — Slater & Matsil, L.L.P.

(57) ABSTRACT

Apparatuses and methods are provided where a predefined voltage may be applied in a feedback circuit of a voltage regulator, the feedback circuit coupling and output terminal with an adjust terminal of the voltage regulator.

12 Claims, 5 Drawing Sheets

APPARATUS PROVIDING AN OUTPUT VOLTAGE

TECHNICAL FIELD

The present application relates to techniques for providing an output voltage, for example, by employing a low-dropout voltage regulator.

BACKGROUND

Apparatuses are known which provide an output voltage at a constant value. One kind of such apparatus is a low-dropout voltage regulator. Here, by means of a feedback circuit, the output voltage is provided at a comparably small difference with respect to a reference voltage. Sometimes the ratio of output voltage with respect to the reference voltage is referred to as gain of the low-dropout voltage regulator. Devices are known which provide a fixed gain typically being larger than unity. However, the fixed character of the gain may impose certain restrictions on system design of electronic circuits. In this regard, increased flexibility in the control of the gain of a low-dropout voltage regulator is sometimes desirable.

BRIEF DESCRIPTION OF THE DRAWINGS

Illustrative embodiments will be explained with reference to the attached drawings, wherein.

DETAILED DESCRIPTION OF ILLUSTRATIVE EMBODIMENTS

Figure 1:
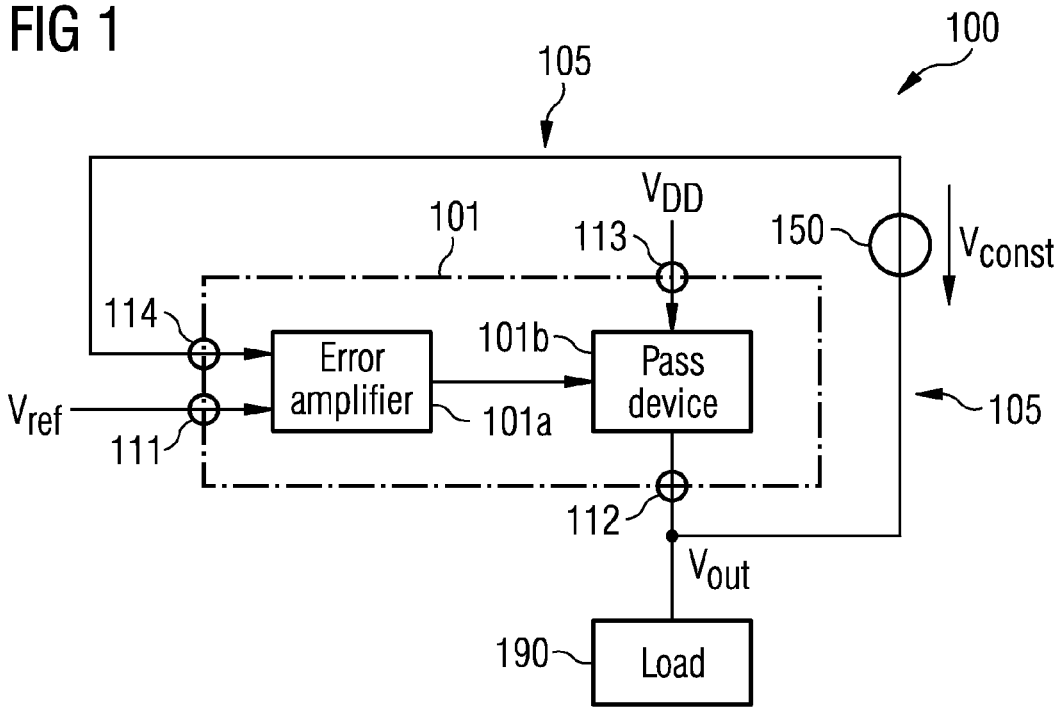
FIG. 1 is a schematic block diagram showing an apparatus according to various embodiments.

In the following exemplary embodiments will be described in detail with reference to the attached drawings. It is emphasized that the embodiments described serve only for illustration purposes and are not to be construed as limiting the scope of the present application.

Features of various embodiments described in the following may be combined with each other unless specifically noted otherwise. Furthermore, describing an embodiment with a plurality of features is not to be construed as indicating that all those features are necessary for practicing the present invention, as other embodiments may comprise less features and/or alternative features to the ones described or shown in the drawings. Furthermore, also additional features, elements, or units known to persons skilled in the art may be incorporated into the embodiments explicitly described without departing from the scope of the present application.

The attached drawings are to be regarded as schematic only, and the various elements are not necessarily shown to scale with respect to each other. Rather, various elements are shown such that their function and general purpose becomes apparent. The illustrated circuits could include additional elements that are not explicitly shown.

In various embodiments as described below, a voltage regulator is employed which comprises an output terminal to provide an output voltage, a reference terminal to receive a reference voltage, and an adjust terminal to receive a feedback voltage from the output terminal via feedback circuit coupled between the output terminal and the adjust terminal. Sometimes the voltage regulator is also referred to as three-terminal adjustable regulator. The voltage regulator provides a constant or fixed output voltage at the output terminal. This facilitates various applications where a well-defined and time-constant voltage is desirable. The voltage regulator typically further comprises an input terminal where a supply voltage is applied.

For example, the voltage regulator may be a low-dropout voltage regulator (LDO). A LDO typically provides the output voltage at a comparably small difference to the reference voltage. For example, the voltage difference between the output terminal and the reference terminal of the LDO may amount to 0.3 Volts or less. Yet, it is also possible that various other types of voltage regulators are employed.

In general, the voltage regulator may be configured to provide the output voltage at a predefined gain with respect to the reference voltage. For example, if the output voltage equals the reference voltage, the gain may be defined as unity. If the output voltage is larger (smaller) than the reference voltage, the gain may be defined to be larger (smaller) than unity. Various definitions of the gain are possible and in a simple scenario the gain may be defined as the ratio of the output voltage to the reference voltage. This definition will be adhered throughout the text for sake of simplicity, but other definitions are possible.

As mentioned above, in various embodiments an LDO may find particular application. Hence, in the following reference is made predominantly to the LDO. However the respective techniques may be readily applied to various other types of voltage regulators.

In the following, techniques are described in which a predefined voltage is applied at the output terminal of the LDO. By such techniques, it is possible to obtain the output voltage at a gain which may be higher or lower than unity, e.g., depending on the predefined voltage. In particular, it is possible to provide an apparatus where the gain can be controlled to be larger or smaller than unity. This greatly increases flexibility in circuit design and enables various applications.

Turning to FIG. 1, an apparatus 100 according to various embodiments is schematically illustrated. The apparatus 100 comprises the LDO 101. In FIG. 1, exemplary constituents of the LDO 101 are shown, i.e., an error amplifier 101*a*, such as an operational amplifier, and a pass device 101*b*, such as a transistor, e.g., a metal-oxide field effect transistor (MOSFET). An output of the error amplifier 101*a* is coupled to an input of the pass device 101*b*. Thereby, an output of the error amplifier 101*a* controls a current flow through the pass device 101*b*.

The LDO 101 comprises the reference terminal 111 which receives a reference voltage $V_{ref}$. Furthermore, the LDO 101 comprises the output terminal 112 where the output voltage $V_{out}$ is provided. A load 190 may be connected to the output terminal 112.

As can be seen from FIG. 1, the output terminal 112 is connected via a feedback circuit 105 with the adjust terminal 114 of the LDO 101. Hence, the output of the pass device 101*b* is coupled with a first input of the error amplifier 101*a* corresponding to the adjust terminal 114 as mentioned above. A second input of the error amplifier, corresponding to the reference terminal 111, is connected with a reference voltage source (not shown in FIG. 1). Typically, the error amplifier 101*a* aims to minimize the difference between the reference voltage $V_{ref}$ applied at the reference terminal 111 and the voltage which is applied at the adjust terminal 114.

A supply voltage $V_{DD}$ is fed to the input terminal 113 of the LDO 101. This input terminal 113 is connected via the pass device 101*b* with the output terminal 112. As mentioned above, the current flow through the pass device 101*b* is controlled by the output of the error amplifier 101*a*.

In the embodiment of FIG. 1, a voltage source circuit 150 is coupled to the feedback circuit 105, i.e., between the first input of the error amplifier 101*a* and the output of the pass device 101*b*, and is configured to apply the predefined voltage $V_{const}$ in the feedback circuit 105. In FIG. 1, the voltage source circuit 150 is schematically shown and various implementations of the voltage source circuit 150 are possible. For example, in a simple scenario, the voltage source circuit 150 may be implemented by dedicated voltage source (not shown in FIG. 1) which applies $V_{const}$.

If the error amplifier 101*a* adjusts its output such that a difference between the voltage applied at the terminals 111, 114 is minimized, then the following equation holds true:

$$V_{out}=V_{ref}-V_{const}$$

If $V_{const}>1$, then $V_{out}<V_{ref}$. Hence, $V_{out}/V_{ref}<1$ which corresponds to a gain smaller than unity. If $V_{const}>1$, then $V_{out}>V_{ref}$. Hence, $V_{out}/V_{ref}>1$ which corresponds to a gain larger than unity.

As has been shown, by appropriately setting $V_{const}$, the gain of the LDO 101 may be set to be smaller or larger than unity. By such means, the load 190 can be served with a tailored output voltage $V_{out}$ depending on the desired gain.

Figure 2:
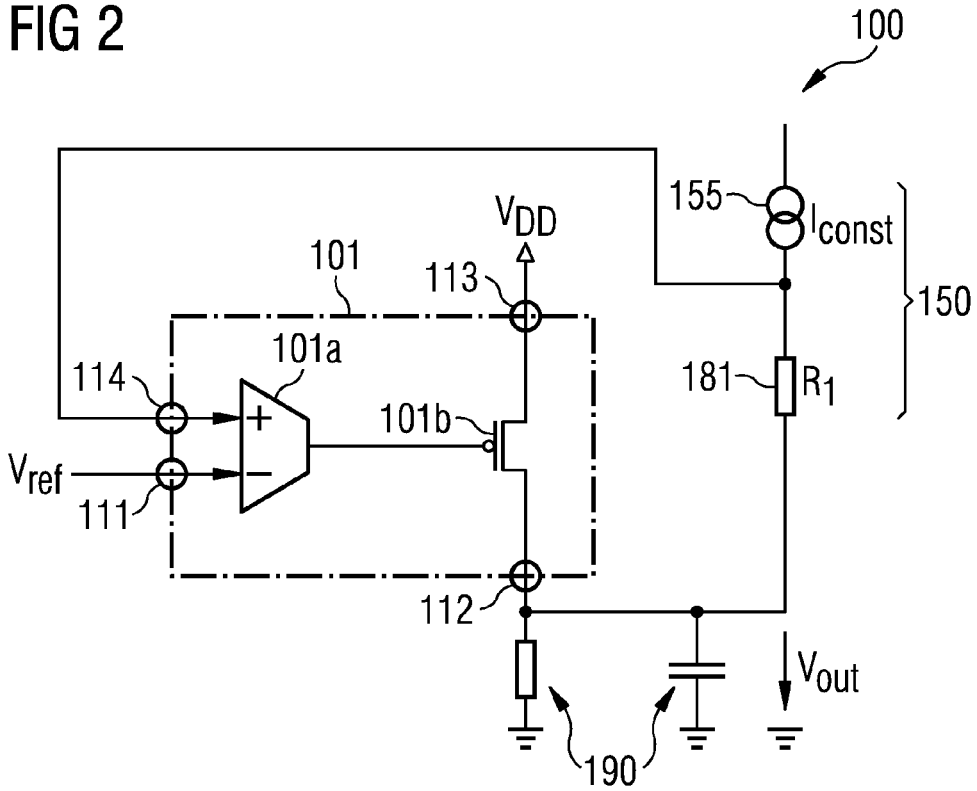
FIG. 2 is a schematic circuit diagram showing a low-dropout voltage regulator of an apparatus according to various embodiments.

In FIG. 2, a more detailed circuit diagram of the apparatus 100 is provided. In FIG. 2, the voltage source circuit 150 is implemented by a current source 155 which is configured to apply a predefined current $I_{const}$ through the resistor 181 labeled R1 in FIG. 2. By appropriately dimensioning the resistance R1 of the resistor 181, the predefined voltage $V_{const}$ can be obtained. For example, it is possible that the resistor 181 has a variable resistance R1. By such techniques, the gain of the LDO 101 may be adjusted by adjusting this variable resistance.

Various implementations of the current source 155 are conceivable. For example, in a simple scenario, a dedicated current source may be provided (not shown in FIG. 2). It may be possible that the apparatus 100 is provided on a chipset which includes a central bias current generator (not shown in FIG. 2). The central bias current generator may fulfill various tasks which do not necessarily need to be in any relationship with the apparatus 100. It is possible, however, that the central bias current generator is connected with the apparatus 100 as the current source 155.

Figure 3:
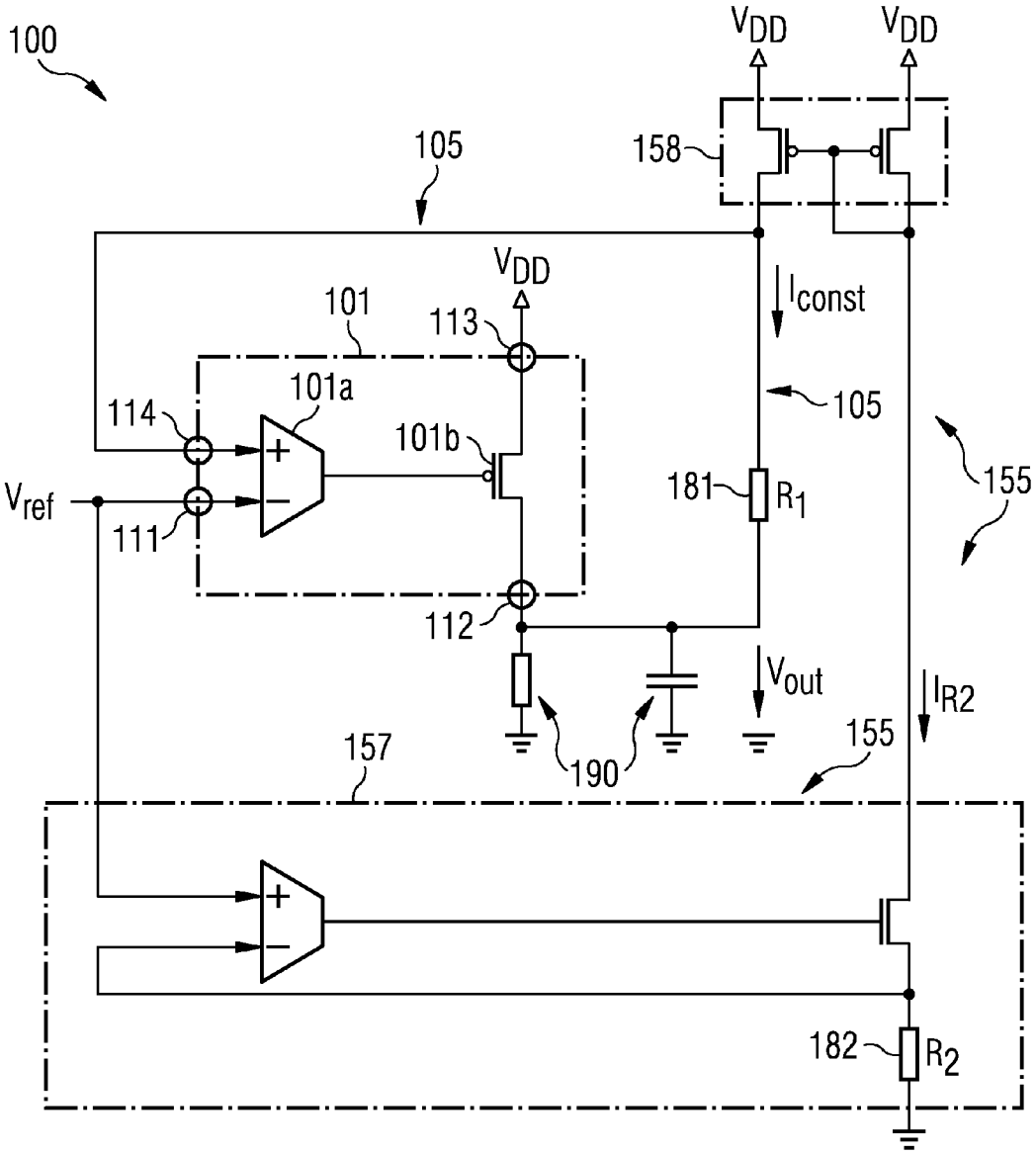
FIG. 3 is a schematic circuit diagram showing a low-dropout voltage regulator and a voltage-to-current converter of an apparatus according to various embodiments.

Turning to FIG. 3, yet a further embodiment of the current source 155 is shown. Namely, in FIG. 3 the current source 155 comprises a voltage-to-current converter 157. The voltage-to-current converter 157 is coupled to the reference terminal 111 and of the LDO 101 is configured to convert the reference voltage $V_{ref}$ into an intermediate current, labeled $I_{R2}$ in FIG. 3. The intermediate current $I_{R2}$ flows through a resistor 182 labeled R2 in FIG. 3. The intermediate current may be set by accordingly dimensioning the constituents of the converter 157. This intermediate current is mirrored into the feedback circuit 105 by a current mirror 158.

Such a setup enables to exploit the reference voltage $V_{ref}$ to provide the predefined voltage $V_{const}$ in the feedback circuit 105. This may yield it expendable to provide a dedicated voltage source and/or dedicated current source to obtain the predefined voltage $V_{const}$. A system design of the apparatus 100 may be simplified. Moreover, it is possible to set the gain by appropriately dimensioning the resistances R1, R2 of the resistors 181, 182, as will be shown below. By such techniques, it is therefore possible to tailor the gain of the LDO 101 by comparably simple means.

As can be seen from FIG. 3, the voltage-to-current converter 157 comprises an operational amplifier, the output of which is coupled to a gate terminal of a MOSFET; hence the output of the operational amplifier controls the current flow between a source terminal and a drain terminal of this MOSFET. The drain terminal of the MOSFET is coupled to one of the inputs of the operational amplifier, thereby constituting a feedback circuit. This voltage-to-current converter 157 yields:

$$I_{R2}=V_{ref}/R_2 \quad (2),$$

i.e., the current flow depends on the reference voltage $V_{ref}$ and the resistance R2 of the resistor 182.

Furthermore, the current mirror 158 comprises two MOSFETs whose gate terminals are coupled. Respectively, to the drain terminals of the MOSFETs of the current mirror 158 the supply voltage $V_{DD}$ is applied. This current mirror 158 yields:

$$I_{const}=YI_{R2} \quad (3),$$

where Y is a proportionality factor which can be set variably in various embodiments. For example, it is possible to have Y=1. Then, combining Eqs. (2) and (3) yields:

$$I_{R1}=V_{ref}/R_2 \quad (4).$$

Combining Eq. 4 with Eq. 1, where $V_{const}=I_{const}R_1$, yields:

$$V_{out}=V_{ref}(R_2-R_1)/R_2 \quad (5).$$

Figure 4:
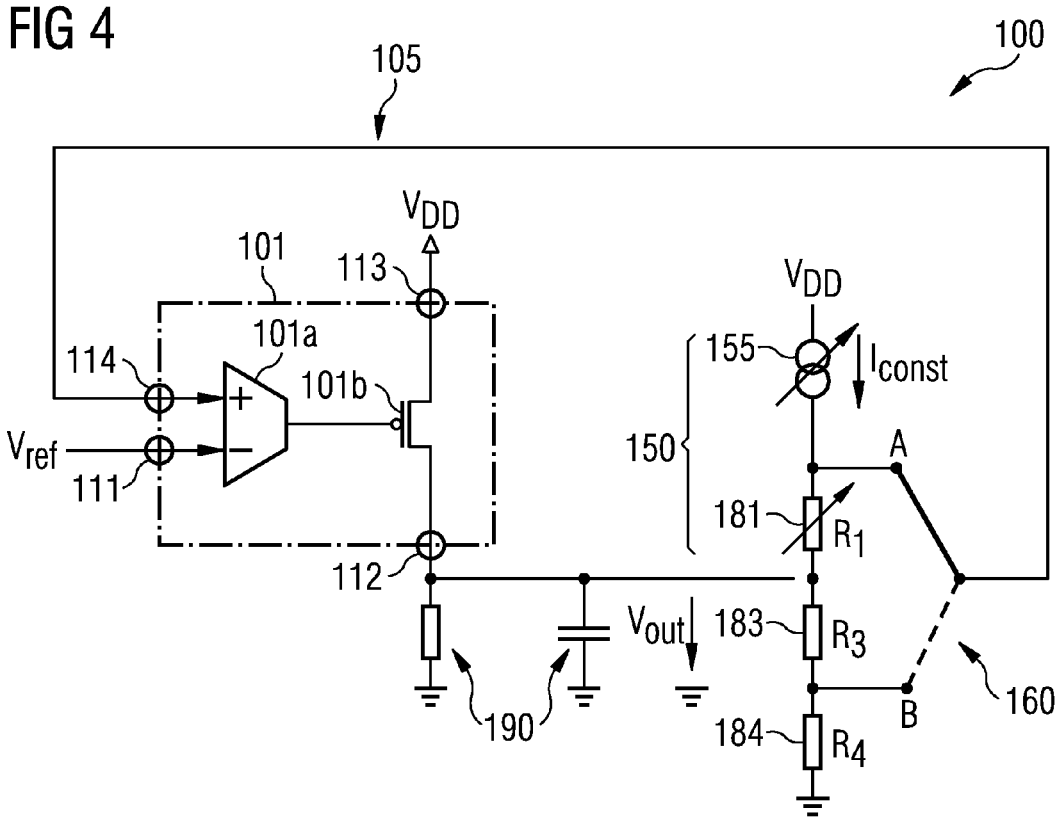
FIG. 4 is a schematic circuit diagram showing a low-dropout voltage regulator and a two-way switch of an apparatus according to various embodiments.

Thus, the gain of the LDO 101 equals $(R_2-R_1)/R_2$. Considering this equation, while—e.g., by using variable resistances R1, R2—the gain may be flexible set to a certain value smaller than unity, it may be also desirable to flexibly set the gain to values larger and smaller than unity. In FIG. 4, an embodiment of the apparatus 100 is shown, which enables to set the gain to values smaller and larger than unity by employing a switch 160. In the embodiment of FIG. 4, the voltage source circuit 150 is implemented by the current source 155 and the resistor 181 having the variable resistance R1. Other implementations of the voltage source circuit 150, e.g., as mentioned above, are possible.

The switch 160, in the embodiment of FIG. 4, is a two-way switch which can be set to a first switch position A and a second switch position B (cf. FIG. 4). If the switch 160 is in the first switch position A, then the voltage source circuit 150 is coupled to the feedback circuit 105; if the switch is in the second switch position B, then the voltage source circuit 150 is excluded from the feedback circuit 105 and the voltage source circuit 150 does not apply the predefined voltage in the feedback circuit 105. In this second switch position B, a resistor 183 labeled R3 is included in the feedback circuit 105, while the feedback circuit 105 is connected via a resistor 184 labeled R4 with mass.

If the switch 160 is in the first switch position A, then—according to the discussion provided above, e.g., with respect to FIGS. 2 and 3—the gain of the LDO 101 typically is lower than unity. If the switch 160 is in the second switch position B, then the gain amounts to 1+R4/R3, i.e., is larger than unity. Thus, by operating the switch 160, the gain of the LDO 101 may be controlled to be smaller or larger than unity.

The output terminal 112 of the LDO 101 draws only little current; therefore, almost the entire current $I_{const}$ flows to the load 190 (not shown in FIG. 4), in particular independent of the position of the switch 160. This results in a comparably low energy consumption where the current $I_{const}$ provided by the current source circuit 155 is used for powering the load 190. Hence, the current source 155 is configured such that the predefined current $I_{const}$ flows towards the load 190.

Figure 5:
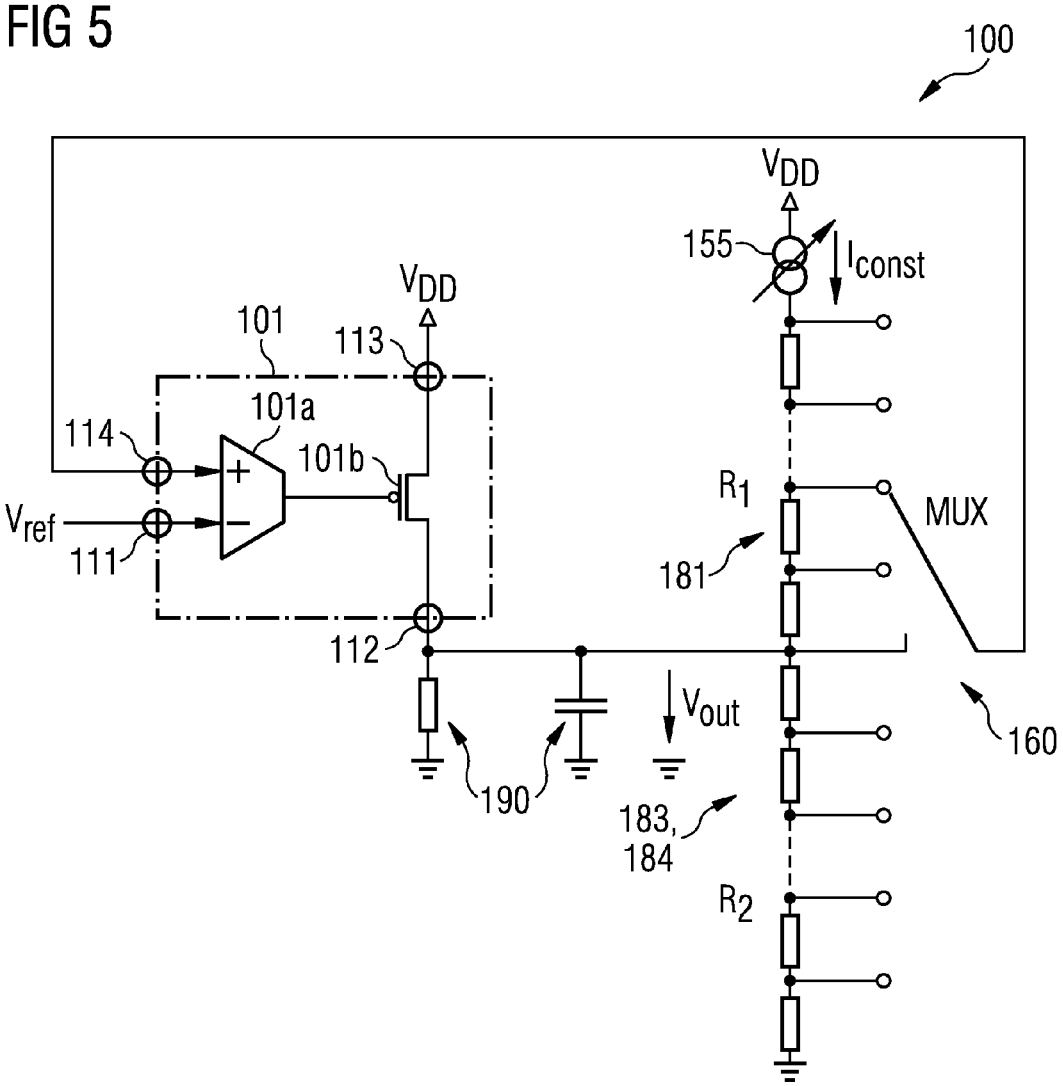
FIG. 5 is a schematic circuit diagram showing a low-dropout voltage regulator and a multi-way switch of an apparatus according to various embodiments.

Turning to FIG. 5, the switch 160 has plural sub-positions of the first switch position A and of the second switch position B. It is also possible that such sub-positions are either provided for the first switch position A or the second switch position B (not shown in FIG. 5).

By such means, a different number of resistors 181, 183, 184 can be selected by appropriately positioning the switch 160 in one of the sub-positions. This enables to control the gain in, both, the first and second switch positions A, B according to the techniques as discussed above. In other words, the LDO 101 may be referred to as being fully programmable.

Figure 6:
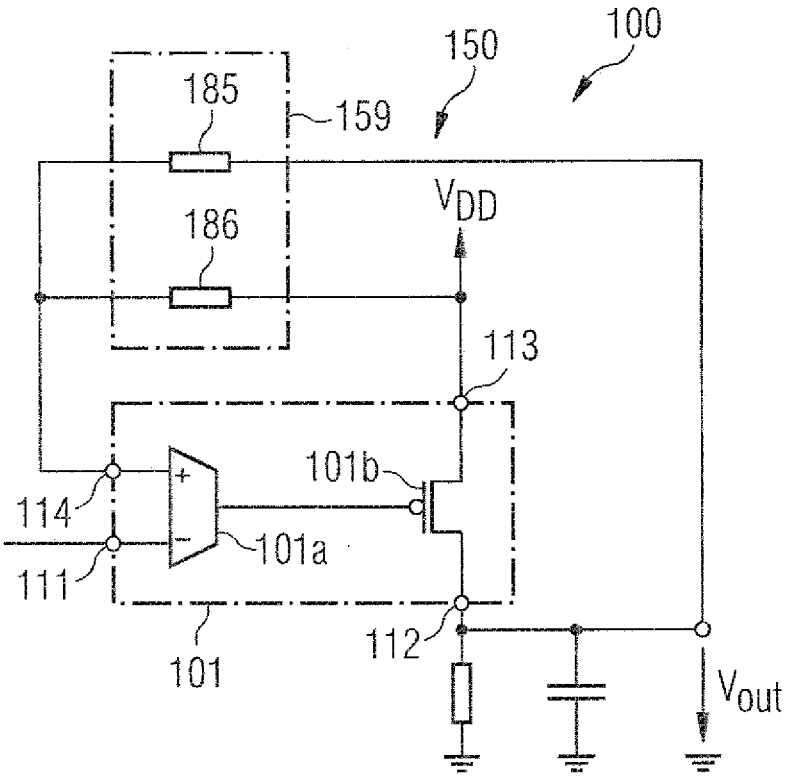
FIG. 6 is a schematic circuit diagram showing a low-dropout voltage regulator of an apparatus according to various embodiments.

In FIG. 6 another embodiment is shown. In this embodiment, a voltage divider 159 is arranged between the input terminal 113 where the supply voltage $V_{DD}$ is applied and the output terminal 112 where the output voltage $V_{out}$ is applied. In other words, the voltage source circuit 150 is further coupled to the input terminal 113 of the LDO 101 and further comprises the voltage divider 159 configured to provide a predefined fraction of the supply voltage $V_{DD}$ as the predefined voltage $V_{const}$.

In such a scenario, it may be particularly simple to provide the voltage source circuit 150. In particular, only few elements, e.g., the two resistors 185, 186 forming the voltage divider may be necessary. Furthermore, it may be possible that the gain depends on the supply voltage $V_{DD}$. Thus it may be possible to control the gain by means of the supply voltage $V_{DD}$.

Figure 7:
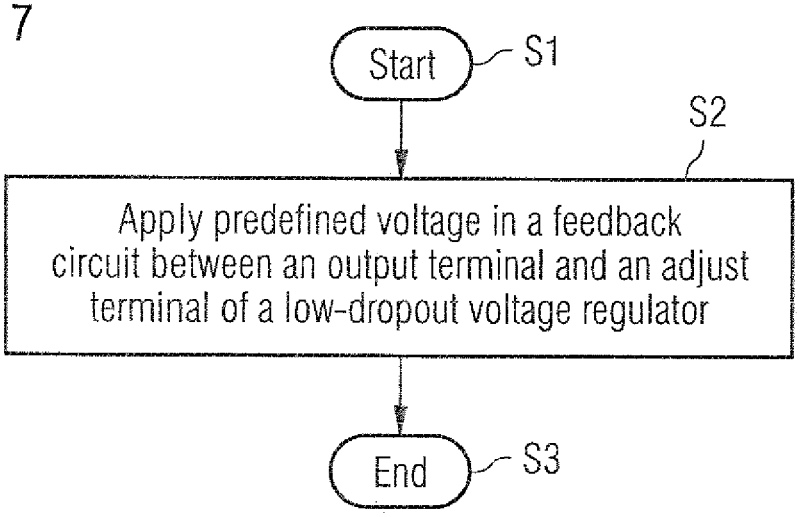
FIG. 7 is a flowchart of a method according to various embodiments.

In FIG. 7, a flowchart of a method according to various embodiments is shown. The method starts in step S1. In step S2, the predefined voltage $V_{const}$ is applied in the feedback circuit 105. The feedback circuit 105 connects the output terminal 112 with the adjust terminal 114 of the LDO 101. The method ends in step S3.

As can be seen from the above detailed description, various modifications and alterations are possible without departing from the scope of the invention. Therefore, the above-described embodiments are not to be construed as limiting the scope in any way, but are merely intended to provide illustrative implementation examples. Moreover, modifications and alterations described for one of the embodiments may also be applied to other embodiments described unless specifically noted otherwise.

What is claimed is:

1. An apparatus comprising:

an output terminal configured to provide an output voltage;

a reference terminal configured to receive a reference voltage;

an adjust terminal configured to receive a feedback voltage from the output terminal via a feedback circuit coupled between the output terminal and the adjust terminal; and a voltage source circuit coupled to the output terminal and being configured to apply a predefined voltage, wherein the apparatus is configured as a voltage regulator that is configured to provide the output voltage at a predefined gain with respect to the reference voltage, and wherein the voltage source circuit is coupled to the feedback circuit and is configured to apply the predefined voltage in the feedback circuit.

2. The apparatus according to claim 1, further comprising an input terminal configured to receive a supply voltage, wherein the voltage source circuit is further coupled to the input terminal and further comprises a voltage divider configured to provide a predefined fraction of the supply voltage as the predefined voltage.

3. The apparatus according to claim 1, further comprising:

a switch having a first switch position and a second switch position, wherein, in the first switch position, the voltage source circuit is coupled to the feedback circuit and provides the predefined voltage in the feedback circuit, and wherein, in the second switch position, the voltage source circuit does not apply the voltage in the feedback circuit.

4. The apparatus according to claim 3, wherein the switch has a plurality of sub-positions of the first switch position, wherein, depending on the sub-position, a different predefined voltage is applied in the feedback circuit.

5. The apparatus according to claim 4, wherein the voltage source circuit comprises a current source configured to provide a predefined current through a plurality of resistors, and wherein, depending on the sub-position of the switch, a different subset of the plurality of resistors is included in the feedback circuit.

6. The apparatus according to claim 1, wherein the voltage source circuit comprises a current source configured to provide a predefined current through at least one resistor, thereby applying the predefined voltage.

7. The apparatus according to claim 6, wherein the at least one resistor has a variable resistance.

8. The apparatus according to claim 6, wherein the current source comprises a voltage-to-current converter that is coupled to the reference terminal and that is configured to convert the reference voltage into an intermediate current, and wherein the current source further comprises a current mirror that is coupled with the voltage-to-current converter and the feedback circuit and that is configured to mirror the intermediate current into the feedback circuit as the predefined current.

9. The apparatus according to claim 6, wherein a load is connected to the apparatus, wherein the current source is configured such that the predefined current flows towards the load.

10. A method comprising:

providing a voltage regulator, configuring the voltage regulator to provide an output voltage at a predefined gain with respect to a reference voltage; and applying a predefined voltage in a feedback circuit coupled between an output terminal and an adjust terminal of the voltage regulator, the output terminal providing the output voltage and the adjust terminal receiving a feedback voltage from the output terminal via the feedback circuit, the feedback voltage being offset against the output voltage by the predefined voltage.

11. An apparatus comprising:

a voltage regulator comprising an error amplifier and a pass device, wherein an output of the error amplifier is configured to control a current flow through the pass device, wherein an output of the pass device is coupled with a first input of the error amplifier and wherein a second input of the error amplifier is coupled to a reference voltage source node; and a voltage source circuit coupled between the first input of the error amplifier and the output of the pass device and being configured to apply a predefined voltage to offset the output of the pass device against the first input of the error amplifier.

12. An apparatus comprising:

an operational amplifier comprising a first input, a second input connected to a reference voltage and an output; and a transistor comprising a gate coupled with the output of the operational amplifier, a source coupled to a supply voltage, and a drain, wherein the drain of the transistor is coupled to the first input of the operational amplifier via a feedback circuit, wherein the feedback circuit comprises a current source configured to apply a predefined current and a resistor to offset the output against the first input of the operational amplifier, and wherein the drain of the transistor is to be connected to a load.

* * * * *